United States Patent [19]

Morrow et al.

[11] 4,411,985

[45] Oct. 25, 1983

[54] HEAT STABILIZABLE PHOTOGRAPHIC SILVER HALIDE MATERIAL AND PROCESS

[75] Inventors: Lawrence R. Morrow, Richmond, Tex.; John Thatcher, Webster, N.Y.

[73] Assignee: Eastman Kodak Company, Rochester, N.Y.

[21] Appl. No.: 303,314

[22] Filed: Sep. 17, 1981

[51] Int. Cl.[3] ..... G03C 1/02; G03C 5/24

[52] U.S. Cl. ..... 430/352; 430/353; 430/610; 430/955; 430/617; 430/619; 430/613; 430/600

[58] Field of Search ..... 430/955, 610, 352, 353, 430/617, 619, 615, 613, 600

[56] References Cited

U.S. PATENT DOCUMENTS

| | | | |
|---|---|---|---|
| 2,238,632 | 4/1941 | Dersch et al. | 430/610 |
| 3,297,446 | 1/1967 | Dunn | 430/613 |
| 3,457,075 | 7/1969 | Morgan et al. | 430/619 |
| 3,615,510 | 10/1971 | Yudelson et al. | 430/355 |
| 3,679,422 | 7/1972 | de Mauriac et al. | 430/353 |
| 3,801,321 | 4/1974 | Evans et al. | 430/355 |
| 3,951,661 | 4/1976 | Soma et al. | 430/610 |
| 3,957,517 | 5/1976 | Ikenoue et al. | 430/352 |
| 4,013,469 | 3/1977 | Haga et al. | 430/447 |
| 4,346,154 | 8/1982 | McLaen et al. | 430/610 |

OTHER PUBLICATIONS

*Research Disclosure*, Jun. 1978, Item No. 17029.

*Research Disclosure*, Dec. 1978, Item No. 17643.

*Primary Examiner*—Won H. Louie, Jr.

*Attorney, Agent, or Firm*—Richard E. Knapp

[57] ABSTRACT

Stabilizer precursors which comprise triarylphosphines and triarylphosphoranes and which, upon being heated to a temperature above about 100° C., release a phosphorous compound silver halide stabilizer that is useful in a heat stabilizable photographic silver halide material comprising photographic silver halide. A stabilized image is produced in the photographic material following exposure and development by heating the material to processing temperature. The triarylphosphines and triarylphosphoranes are useful in a dry physical development photographic material and process. Alternatively, the triarylphosphines and triarylphosphoranes are useful in a dry chemical photographic material and process.

63 Claims, No Drawings

HEAT STABILIZABLE PHOTOGRAPHIC SILVER HALIDE MATERIAL AND PROCESS

BACKGROUND OF THE INVENTION

1. Field of the Invention

This invention relates to triarylphosphine and triarylphosphorane silver halide stabilizer precursors in heat stabilizable photographic silver halide materials. It also relates to processes of stabilization of heat stabilizable photographic silver halide materials by means of such stabilizer precursors.

2. Description of the State of the Art

Phosphorous compounds have been described in photographic silver halide materials as additives, such as antifoggants. This is described in, for instance, U.S. Pat. No. 3,951,661. These phosphorous compounds are phosphonium compounds, not phosphines or phosphoranes.

Silver halide stabilizer precursors have been described in heat stabilizable silver halide photographic materials. These stabilizer precursors are described in, for instance, *Research Disclosure*, June 1978, Item No. 17029. Stabilizers and stabilizer precursors described in heat stabilizable silver halide photographic materials are almost all sulfur compounds, not phosphorous compounds. It has been desirable to provide phosphorous compounds that enable improved stability of silver halide sensitization at low levels of stabilizer compared to sulfur compounds. No answer to the problem of what phosphorous compound is useful to replace a sulfur compound silver halide stabilizer precursor is found in the art.

The term "material" herein, such as in "photographic silver halide material", refers to photographic elements and photographic compositions. For instance, the term "heat stabilizable photographic silver halide material" refers to photographic elements and photographic compositions that are heat stabilizable.

SUMMARY OF THE INVENTION

According to the invention, a stabilized silver image is provided in a heat stabilizable photographic silver halide material. This material, according to the invention, comprises, in binder, in reactive association, (a) photographic silver halide, and (b) a silver halide stabilizer precursor. The silver halide stabilizer precursor according to the invention comprises a triarylphosphine or triarylphosphorane compound which, upon being heated to a temperature above about 100° C., releases a phosphorous compound silver halide stabilizer that contains a lone electron pair on the phosphorous atom of the stabilizer.

An example of a useful heat developable and heat stabilizable photographic material according to the invention comprises, in a gelatino binder, in reactive association: (a) photographic silver halide, (b) a silver halide developing agent, (c) a buffering concentration of an organic acid buffering agent, and (d) a stabilizing concentration of a triarylphosphine or triarylphosphorane silver halide stabilizer precursor. This is a dry chemical development photothermographic material according to the invention.

Another example of a useful heat developable and heat stabilizable photographic material according to the invention comprises, in a polymeric binder, in reactive association: (a) photographic silver halide, (b) an oxidation-reduction image-forming combination comprising (i) an organic silver salt oxidizing agent, with (ii) a reducing agent for the organic silver salt oxidizing agent, and (c) a stabilizing concentration of a triarylphosphine or triarylphosphorane silver halide stabilizer precursor. This is a dry physical development photothermographic material according to the invention.

Triarylphosphine and triarylphosphorane silver halide stabilizer precursors according to the invention are also useful in a heat activatable photographic silver halide processing composition comprising a silver halide developing agent. This processing composition is, for example, in the form of a layer, such as an overcoat layer, in a photographic silver halide element.

A developed image in a heat stabilizable photographic material according to the invention is stabilized by heating the photographic material to processing temperature, that is, a temperature within the range of about 100° C. to about 180° C. until the developed image is stabilized. At processing temperature, a phosphorous compound silver halide stabilizer that contains a lone electron pair on the phosphorous atom of the stabilizer is released from the stabilizer precursor. The released stabilizer then reacts with the undeveloped silver halide in the photographic silver halide material to form a stable silver image.

DETAILED DESCRIPTION OF THE INVENTION

Many triarylphosphines and triarylphosphoranes are useful silver halide stabilizer precursors according to the invention. Combinations of triarylphosphines and triarylphosphoranes are also useful silver halide stabilizer precursors. It is important that the triarylphosphine or triarylphosphorane or combination thereof be capable, upon being heated to processing temperature, that is, a temperature within the range of about 100° C. to about 180° C., of releasing a phosphorous compound silver halide stabilizer. Selection of an optimum triarylphosphine or triarylphosphorane or combination thereof will depend upon such factors as the desired image stability, particular components of the photographic silver halide material or processing composition, processing conditions, the particular photographic silver halide in the photographic material, and the particular developing agent.

The term "aryl", such as in "triarylphosphine" and "triarylphosphorane", herein includes unsubstituted aryl groups and aryl groups which contain substituent groups which do not adversely affect the desired stabilizing properties of the stabilizer precursor according to the invention, or do not adversely affect the desired photographic properties or other desired properties of a photographic material according to the invention. Useful substituent groups include, for example, methoxy, hydroxy, methyl and chloro.

The triarylphosphine and triarylphosphorane silver halide stabilizer precursors according to the invention are useful in a range of concentrations in a photographic silver halide material. The silver halide stabilizer precursors are also useful in a range of concentrations in a photographic silver halide processing composition. Selection of an optimum concentration of triarylphosphine or triarylphosphorane or combinations thereof depend upon such factors as the desired image stability, particular components of the photographic silver halide material or processing composition, the particular photographic silver halide in the photographic material to be processed, processing conditions, and the particular developing agent. A useful concentration of triarylphosphine and triarylphosphorane stabilizer precursor is within the range of 1.5 mole to 3.0 moles of stabilizer precursor per mole of total silver in the photographic silver halide material.

An example of a triarylphosphine silver halide stabilizer precursor, preferably a triphenylphosphine silver halide stabilizer precursor, is represented by the formula:

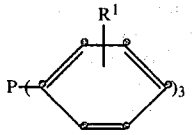

wherein:

$R^1$ is hydrogen; alkyl containing 1 to 3 carbon atoms, such as methyl, ethyl, and propyl; hydroxyl; alkoxy containing 1 to 3 carbon atoms, such as methoxy and ethoxy, chlorine; bromine, fluorine and iodine; or

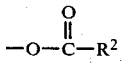

wherein $R^2$ is alkyl containing 1 to 3 carbon atoms, such as methyl, ethyl, and propyl.

Examples of triphenylphosphines within this structure include triphenylphosphine, tri-para-tolyl phosphine, tris-(4-methoxyphenyl)phosphine and tris-(4-chlorophenyl)phosphine.

Another example of a stabilizer precursor according to the invention is a phosphorane represented by the formula:

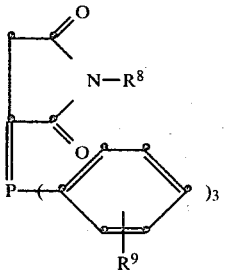

wherein:

$R^8$ is hydrogen; alkyl containing 1 to 20 carbon atoms, such as methyl, ethyl, propyl and decyl; or aryl containing 6 to 12 carbon atoms, such as phenyl and tolyl; and $R^9$ is hydrogen; alkyl containing 1 to 3 carbon atoms, such as methyl, ethyl and propyl or hydroxyl.

Examples of compounds within this phosphorane structure include 3-triphenylphosphoranylidene-N-ethyl succinimide represented by the formula:

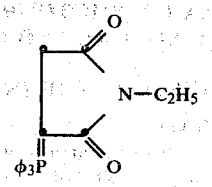

and 3-triphenyl phosphoranylidene-N-phenyl succinimide represented by the formula:

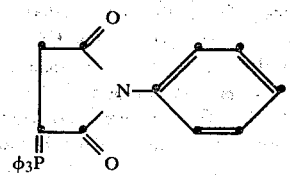

The designation $\phi$ herein represents a phenyl group.

A further example of a stabilizer precursor according to the invention is a triphenylphosphorane represented by the formula:

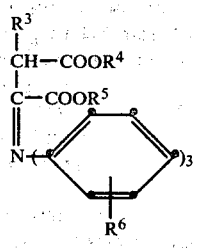

wherein:

$R^3$ is hydrogen or alkyl containing 1 to 3 carbon atoms, such as methyl, ethyl and propyl;

$R^4$ and $R^5$ are individually hydrogen or alkyl containing 1 to 20 carbon atoms, such as methyl, ethyl, octyl and decyl; and, $R^6$ is hydrogen, alkyl containing 1 to 3 carbon atoms, such as methyl, ethyl and propyl; hydroxyl; alkoxy containing 1 to 3 carbon atoms, such as methoxy, ethoxy, and propoxy; chlorine, bromine, fluorine or iodine, or

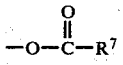

wherein $R^7$ is alkyl containing 1 to 3 carbon atoms, such as methyl, ethyl, and propyl.

Examples of triphenylphosphorane compounds within this structure are dimethyl-2-tris(3-hydroxyphenyl)phosphoranylidene succinate represented by the formula:

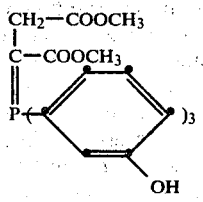

and diethyl-2-triphenylphosphoranylidene succinate represented by the formula:

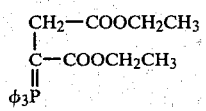

The triarylphosphines and triarylphosphoranes according to the invention are prepared by methods known in the chemical synthesis art. The triarylphosphines are known compounds or are compounds prepared by known methods. The preparation of 1,2-dimethoxycarbonylethyltriphenylphosphorane is illustrative of a preparation of a stabilizer precursor according to the invention. This preparation is carried out as follows:

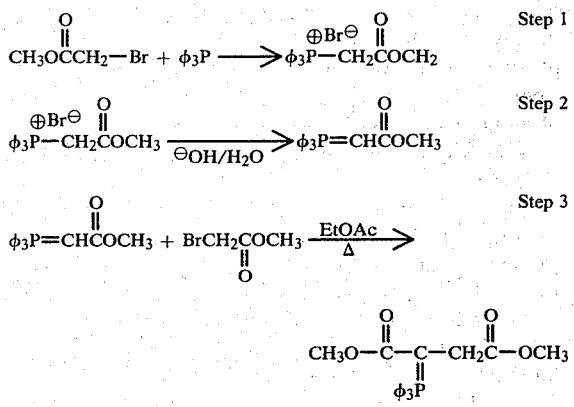

In this preparation, Step 1 involves the preparation of carbomethoxymethyltriphenylphosphonium bromide as follows: triphenylphosphine (52.5 grams) is added in a three-neck 500 ml round-bottom flask with 150 ml of toluene and the resulting solution is stirred. Then methylbromoacetate (30.6 grams) is added dropwise to the solution. The temperature of the reaction mixture rises slightly and a white precipitate is formed having a melting point of 154° C.

Step 2 involves the preparation of carbomethoxymethylenetriphenylphosphorane as follows: the phosphonium salt from Step 1 is added (25 grams) to a one-liter three-neck round-bottom flask with 500 ml of cold water to form a suspension. 60 ml of six normal sodium hydroxide (24 grams in 100 cc of water) is added dropwise to the suspension. A white solid is formed. The suspension mixture tests basic to phenophthaline (turns deep purple). The resulting solid is filtered, washed with water and dried. It is then recrystallized from ethyl acetate to produce the desired product having a melting point of 165° to 167° C.

In Step 3, the following procedure is carried out: 100 ml of dry ethyl acetate is mixed with 8.5 grams of carbomethoxymethylenetriphenylphosphorane prepared in Step 2 in a 500 ml round-bottom flask to form a suspension. Methylbromoacetate (3.8 grams) is added to the suspension and the resulting mixture is refluxed for four hours. The suspension is filtered while hot, and the filtrate evaporated to provide a white solid. The white solid is recrystallized from ethyl acetate to provide the desired product having a melting point of 160° to 162° C. The desired product is identified by known analytical procedures, such as elemental analysis.

An alternative preparation for triarylphosphoranes from symmetrical diesters is as follows:

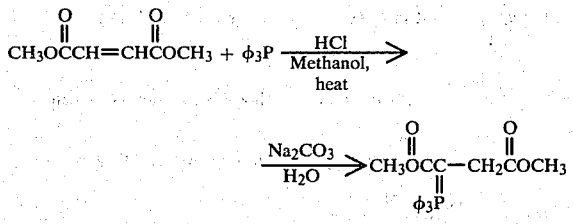

In this preparation, the following steps are carried out: dimethylfumarate (10 grams) is dissolved in 200 ml of methanol by warming the mixture. Triphenylphosphine (18.2 grams) is added. The triphenylphosphine dissolves in the methanol. The solution is then saturated with hydrogen chloride (bubbled into the reaction mixture for one to two minutes). The mixture is then boiled for one-half hour and then re-saturated with hydrogen chloride and allowed to stand at room temperature (about 19° C.) for one-half hour. The solution is evaporated to provide a gummy oil. A saturated solution of sodium carbonate is added and, with vigorous agitation, the gum slowly precipitates a white solid. This is filtered, washed with water, dried and then recrystallized from ethyl acetate to provide the desired product having a melting point of 160° to 163° C.

Another example of a method of preparing a triarylphosphorane is as follows:

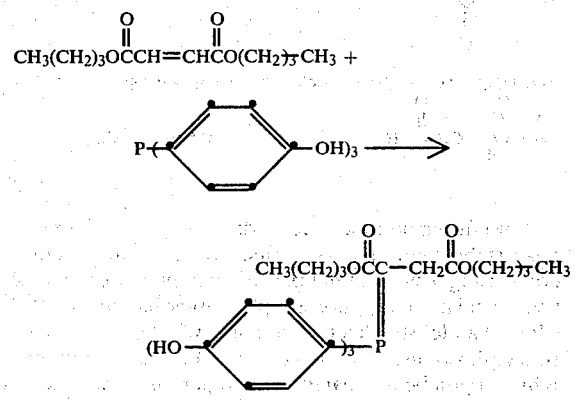

According to this preparation, 50 ml of butyl alcohol is added to tris(4-hydroxyphenyl)phosphine (15.5 grams) in a three-neck 500 ml round-bottom flask. The resulting suspension is heated on a steam bath until a solution is formed. Then dibutylfumarate (11.8 grams) is added, and the solution is heated for ten minutes. Then the reaction mixture is cooled to room temperature (about 19° C.). 100 ml of ethyl ether is added to the suspension, and the resulting mixture is stirred. A white solid is formed which is filtered and recrystallized from 225 ml of butyl alcohol. Other phosphorane stabilizer precursors which are synthesized based on one of the described procedures are as follows:

diethyl-2-triphenylphosphoranylidene-succinate

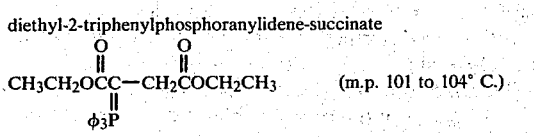

-continued methyl-2-triphenylphosphoranylidene-3-ethoxycarbonyl propionate

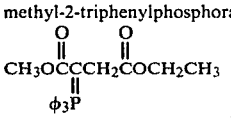

(m.p. 150 to 152° C.)

di-isopropyl-2-tris(4-hydroxyphenyl)phosphoranylidene-succinate

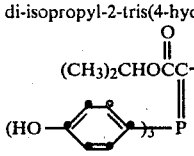

(m.p. 180 to 181° C.)

1-phenyl-1-oxo-2-triphenylphosphoranylidene-3-methoxy-carbonyl-propane

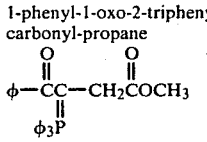

(m.p. 166 to 167° C.)

dimethyl-2-triphenylphosphoranylidene-succinate

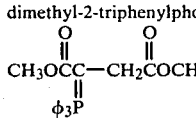

(m.p. 117 to 118° C.)

N—ethyl-3-triphenylphosphoranylidene-succinimide

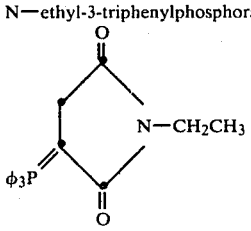

(m.p. 168 to 170° C.)

3-methoxycarbonyl-3-triphenylphosphoranylidene-propionic acid

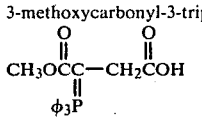

(m.p. 155 to 157° C.)

A useful embodiment according to the invention is a heat stabilizable photographic silver halide element comprising a support having thereon, in binder, in reactive association: (a) photographic silver halide, and (b) a silver halide stabilizer precursor which comprises a triarylphosphine or triarylphosphorane compound which, upon being heated to a temperature above about 100° C., releases a phosphorous compound silver halide stabilizer that contains a lone electron pair on the phosphorous atom of the stabilizer.

The photographic materials according to the invention contain photographic silver halide. Useful photographic silver halides include, for example, silver chloride, silver bromide, silver bromoiodide, silver chlorobromoiodide, silver iodide and mixtures thereof. The photographic silver halide has a range of grain size from coarse grain to fine grain. The materials containing the photographic silver halide are prepared by procedures known in the photographic art. The stabilizer precursors according to the invention are especially useful with silver bromide and silver bromoiodide photographic materials. The procedures for preparing photographic silver halides that are useful according to the invention are described in, for example, *Research Disclosure,* December 1978, Item No. 17643.

The photographic silver halide is useful in a range of concentrations in the photographic silver halide materials according to the invention. A concentration of photographic silver halide is generally present in the photographic material which produces a photographic element within the range of about 10 to about 300 mg of silver per square decimeter.

The photographic silver halide, if desired, is chemically sensitized, and contains development modifiers that function as speed-increasing compounds, as well as antifoggants and emulsion stabilizers, as described in *Research Disclosure,* December 1978, Item No. 17643.

The photographic materials according to the invention generally contain addenda, such as hardeners, plasticizers, lubricants, coating aids, matting agents, brighteners, absorbing and filter dyes and antistatic layers, as described in *Research Disclosure,* December 1978, Item No. 17643, and in *Research Disclosure,* June 1978, Item No. 17029.

The compositions containing the components necessary to produce a photographic element according to the invention have a range of pH values. Generally, a pH of a coating composition to produce a photographic element according to the invention is within the range of about 4 to about 9 for a photographic element designed for dry chemical development. A generally useful pH of a coating composition to produce a photographic element for dry physical development is within the range of about 2 to about 9. A preferred range for phosphines and phosphoranes is within the range of 4.0 to 6.0 pH.

A stabilizer precursor according to the invention is especially useful in stabilizing a heat developable and heat stabilizable photographic material designed for dry chemical development. The term "dry chemical development" herein means an imaging material that combines dry development and chemical development of a photographic silver halide material, such as described in *The Theory of the Photographic Process,* T. H. James Editor, Fourth Edition, 1977, page 374. A photographic element which is an embodiment of the invention designed for dry chemical development is a heat developable and heat stabilizable photographic element comprising a support having thereon, in a gelatino binder, in reactive association: (a) photographic silver halide, (b) a silver halide developing agent, (c) a buffering concentration of an organic acid buffering agent, and (d) a stabilizing concentration of a triarylphosphine or triarylphosphorane silver halide stabilizer precursor which, upon being heated to a temperature above about 100° C., releases a phosphorous compound silver halide stabilizer that contains a lone electron pair on the phosphorous atom of the stabilizer.

An especially useful embodiment according to the invention is a heat developable and heat stabilizable photographic element comprising a support having thereon, in a gelatino binder, in reactive association: (a) photographic silver halide, (b) an ascorbic acid silver halide developing agent, (c) an organic acid buffering agent consisting essentially of methylsuccinic acid, (d) an anti-foggant concentration of a silver halide antifoggant, such as a tetraazaindene antifoggant, and (e) a stabilizing concentration of a silver halide stabilizer precursor consisting essentially of dimethyl-2-tris(3-hydroxylphenyl)phosphoranylidene-succinate represented by the formula:

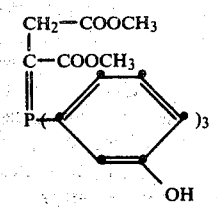

A silver halide developing agent is generally present in the photographic silver halide material according to the invention to provide a developed image. Useful silver halide developing agents include, for example, polyhydroxybenzenes, such as hydroquinone developing agents, including, for example, hydroquinone, alkyl-substituted hydroquinones, such as tertiarybutylhydroquinone, methylhydroquinone, 2,5-dimethylhydroquinone and 2,6-dimethylhydroquinone; catechols and pyrogallol; chlorohydroquinone or dichlorohydroquinone; alkoxy-substituted hydroquinone, such as methoxyhydroquinone or ethoxyhydroquinone; methylhydroxynaphthalene; methylgallate; aminophenol developing agents, such as 2,4-diaminophenols and ethylaminophenols; ascorbic acid developing agents, such as ascorbic acid, ascorbic acid ketals and ascorbic acid derivatives; hydroxylamine developing agents; pyrimidine developing agents; 3-pyrazolidone developing agents, such as 1-phenyl-3-pyrazolidone and 4-methyl-4-hydroxymethyl-1-phenyl-3-pyrazolidone; hydroxytetronic acid and hydroxytetronimide developing agents; reductone developing agents, such as anhydrodihydropiperidinohexosereductone; and furanone developing agents. Combinations of developing agents are also useful.

The term "silver halide developing agent" herein includes developing agents and developing agent precursors. That is, the term includes compounds known as precursors which form a silver halide developing agent upon exposure to suitable energy, for example, light or heat.

The photographic silver halide developing agent is useful in a range of concentrations in the heat developable and heat stabilizable photographic materials according to the invention. A concentration of photographic silver halide developing agent is useful within the range of about 0.1 to about 2.0 moles of developing agent per mole of silver in the photographic material. The optimum concentration of developing agent will depend upon such factors as the desired image, particular photographic silver halide, the particular stabilizer precursor, processing conditions, and other addenda in the photographic materials.

An organic acid buffering agent is especially useful in a photographic material according to the invention designed for dry chemical development. Combinations of organic acid buffering agents are useful. Useful organic acid buffering agents are those which aid in providing a desired pH range in the photograhic material, especially during processing. Examples of useful organic acid buffering agents include methylsuccinic acid, malic acid, benzoic acid, and succinic acid.

The organic acid buffering agent is useful in a photographic material according to the invention in a range of concentrations. The concentration of organic acid buffering agent is generally within the range of about 1 to about 2 moles per mole of silver. The optimum organic acid buffering agent and optimum concentration of buffering agent will depend upon such factors as the particular photographic silver halide, the particular stabilizer precursor and developing agent, processing conditions and the desired image.

Another embodiment of the invention comprises a heat developable and heat stabilizable photographic material comprising a concentration of organic acid which is not necessarily a buffering agent, but which aides release of a silver halide stabilizer from a stabilizer precursor according to the invention. Such an organic acid is, for example, benzoic acid or malic acid.

An auxiliary stabilizer precursor is often useful in the photographic material of the invention. Useful auxiliary stabilizer precursors include, for example, activator-stabilizer precursors known to be useful in dry chemical development photothermographic materials. Examples of useful auxiliary activator stabilizer precursors are those having a base portion which is a protonated basic nitrogen-containing moiety and an acid portion that is an alpha-sulfonyl acetate, as described in U.S. Pat. No. 4,060,420. Other useful auxiliary stabilizer precursors are described in *Research Disclosure,* June 1978, Item No. 17029.

The heat stabilizable photographic materials according to the invention comprise a variety of vehicles and binders. The vehicles and binders are useful alone or in combinations. Useful vehicles and binders include both naturally-occurring substances, such as proteins, for example, gelatin, gelatin derivatives, cellulose derivatives, polysaccharides such as dextran, and synthetic polymeric materials, such as water-soluble polyvinyl compounds like poly(vinyl pyrrolidone) and acrylamide polymers. A gelatino binder is especially useful in a heat devlopable and heat stabilizable photographic material designated for dry chemical development.

The photographic layer and other layers of the photographic element according to the invention alternatively comprise an overcoat layer, an interlayer and subbing layer also containing, alone or in combination, vehicles and other synthetic polymeric materials. Such polymeric materials include, for example, dispersed vinyl compounds, for example, in latex form, and particular those which increase the dimensional stability of the photographic materials. Useful synthetic polymers are described in the above *Research Disclosure* publication. Effective polymeric binders include water-insoluble polymers of alkylacrylates and methacrylates, acrylic acid, sulfoalkylacrylates or methacrylates, and those which have crosslinking sites which facilitate hardening or curing, as well as those having sulfobetaine units. Especially effective polymeric binders are those which are able to withstand processing temperatures above 100° C. without adverse changes in properties, such as adverse changes in dimensional stability.

The photographic elements according to the invention comprise supports. It is essential that the supports be able to withstand the described processing temperatures to avoid adverse sensitometric and other effects during processing. Supports which are useful include cellulose ester, poly(vinyl acetal), poly(ethylene terephthalate), polycarbonate and related films and resinous materials, as well as glass, paper, metal and the like. A flexible support is generally most useful, especially a paper support or transparent film support.

The photographic materials according to the invention generally contain spectral sensitizing dyes to confer additional sensitivity to the photographic silver halide.

Combinations of spectral sensitizing dyes are useful. Useful spectral sensitizing dyes for spectrally sensitizing the photographic silver halide are described in, for example, *Research Disclosure,* June 1978, Item No. 17029.

Addenda useful in the photographic materials according to the invention are generally incorporated into these materials from aqueous compositions, such as water solutions or organic solvent compositions, such as organic solvent solutions.

The stabilizer precursors according to the invention are useful in a variety of physical locations in a photographic element according to the invention. The stabilizer precursors are useful in one or more layers of the photographic element, such as in the photographic silver halide containing layer, and/or an overcoat layer, and/or a layer between the photographic silver halide containing layer and the support. It is necessary that the stabilizer precursor according to the invention be in a location with respect to the photographic silver halide which enables the desired interaction of the stabilizer released from the stabilizer precursor at processing temperature. The stabilizer precursors are generally located in a layer contiguous to the layer containing photographic silver halide. The term "in reactive association" herein means that the described compounds, especially the stabilizer precursors according to the invention, are in such a location which enables the desired interaction to produce a stabilized image upon processing.

The stabilizer precursors according to the invention are useful in many heat stabilizable photographic materials. For instance, a heat developable and heat stabilizable photographic material in which the stabilizer precursors according to the invention are useful comprises, in a polymeric binder, in reactive association: (a) photographic silver halide, (b) an oxidation-reduction image-forming combination comprising (i) an organic silver salt oxidizing agent, with (ii) a reducing agent, preferably an organic reducing agent, for the organic silver salt oxidizing agent, and (c) a stabilizing concentration of a silver halide stabilizer precursor which comprises a triarylphosphine or triarylphosphorane stabilizer precursor according to the invention. This heat developable and heat stabilizable photographic material is designed for dry physical development.

The photographic silver halide which is useful in a heat developable and heat stabilizable photographic material designed for dry physical development according to the invention is prepared by procedures known in the photothermographic art. Such procedures and forms of photographic silver halide are described in, for example, *Research Disclosure,* June 1978, Item No. 17029. These procedures include preparation of photographic silver halide ex situ or in situ in the photographic material. An especially useful method of preparing photographic silver halide for a heat developable and heat stabilizable photographic material designed for dry physical development is one in which the photographic silver halide is prepared ex situ in the presence of a suitable synthetic polymeric peptizer. Poly(vinyl acetals), such as poly(vinylbutyral), are especially useful as peptizers in preparation of ex situ silver halide. The preparation of ex situ silver halide is generally carried out in a non-aqueous medium under controlled reaction conditions.

The heat developable and heat stabilizable photographic materials of the invention designed for dry physical development compise a silver salt oxidizing agent which is an organic silver salt. A useful organic silver salt oxidizing agent is a silver salt of a long-chain fatty acid. The silver salt of the long-chain fatty acid is one which is resistant to darkening under illumination. An especially useful class of silver salts of long-chain fatty acids comprises fatty acids containing from 10 to 30 carbon atoms in the fatty acid chain. Such compounds include, for example, silver behenate, silver stearate, silver oleate, silver laurate, silver caprate, silver myristate and silver palmitate. Silver stearate and silver behenate are especially useful organic silver salt oxidizing agents. Combinations of silver salt oxidizing agents are also useful. Silver salts which are not silver salts of long-chain fatty acids are useful. Such silver salt oxidizing agents include, for example, silver benzotriazole and silver imidazole. Selection of an optimum silver salt oxidizing agent will depend upon the described factors, including the desired image, the particular stabilizer precursor, processing conditions, the particular reducing agent and the photographic silver halide.

The reducing agent in a heat developable and heat stabilizable photographic material designed for dry physical development according to the invention is generally not the same reducing agent that is most useful in a photographic material designed for dry chemical development. Reducing agents that are useful in materials designed for dry physical development include phenolic reducing agents, such as sulfonamidophenols, as described in U.S. Pat. No. 3,801,321, and reducing agents described in *Research Disclosure,* December 1978, Item No. 17029. Especially useful reducing agents include, for example, benzenesulfonamidophenol reducing agents, such as 2,6-dichloro-4-benzenesulfonamidophenol, 2,6-dibromo-4-benzenesulfonamidophenol and 4-benzenesulfonamidophenol. Combinations of such reducing agents are also useful.

In a heat developable and heat stabilizable photographic material designed for dry physical development, a synthetic polymeric binder is most useful, rather than a gelatino binder. Useful synthetic polymeric binders are hydrophobic or hydrophilic. They are generally transparent or translucent and include such polymeric compounds as water-soluble polyvinyl compounds, like poly(vinyl pyrrolidone), acrylamide polymers and acrylate polymers. Especially useful polymeric binders include poly(vinyl butyral), cellulose acetate butyrate, polymethylmethacrylate, vinyl chloride-vinyl acetate copolymers and poly(vinyl alcohol). Combinations of synthetic polymeric binders are also useful.

Toning agents are also useful in the photographic materials according to the invention, especially in heat developable and heat stabilizable photographic materials designed for dry physical development. Such toning agents are also known as activator-toning agents, or toner accelerators. These toning agents are useful for providing a more neutral (black) tone image upon processing. Combinations of toning agents are also useful. Examples of useful toning agents include, for instance, phthalimide, succinimide, phthalazinone, and phthalazine.

Photographic elements according to the invention generally comprise an overcoat layer to increase resistance to abrasion and other marks during processing. Many polymers are useful in a protective overcoat on a photographic element according to the invention. Examples of useful polymers include cellulose acetate, poly(vinyl chloride), cellulose acetate butyrate, and poly(vinyl butyral). Combinations of polymeric materials are useful as overcoat layers.

The stabilizer precursors according to the invention are also useful in photographic silver halide processing compositions which enable use of the stabilizer release properties of the stabilizer precursor. Such heat activatable photographic silver halide processing compositions include, for example, heat activatable silver halide developers, stabilizing compositions, fixing compositions, hardeners and base release compositions. An embodiment of a heat activatable photographic silver halide processing composition comprises: (a) a silver halide developing agent, and (b) a triarylphosphine or triarylphosphorane silver halide stabilizer precursor according to the invention. Such a composition alternatively also comprises a concentration of an organic acid, such as benzoic acid, which aides release of a silver halide stabilizer from the stabilizer precursor.

An example of a heat activatable photographic silver halide processing composition according to the invention comprises an ascorbic acid silver halide developing agent and a phosphorous silver halide stabilizer precursor consisting essentially of N-ethyl-3-triphenylphosphoranylidene-succinimide represented by the formula:

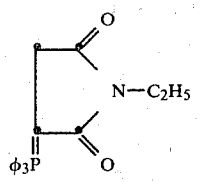

Such a photographic silver halide processing composition preferably comprises a gelatino binder.

Another example of heat activatable photographic silver halide processing composition comprises an ascorbic acid silver halide developing agent and a phosphorous compound silver halide stabilizer precursor consisting essentially of dimethyl-2-tris(3-hydroxyphenyl) phosphoranylidene-succinate represented by the formula:

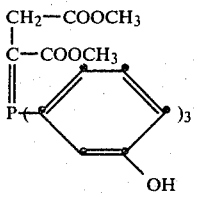

Such a photographic silver halide processing composition preferably comprises a gelatino binder.

The photographic elements according to the invention are imagewise exposed with various forms of energy. Such forms of energy include those to which the photographic silver halide is sensitive and encompass the ultraviolet, visible and infrared regions of the electromagnetic spectrum, as well as electron beam and beta radiation, gamma ray, X-ray, alpha particle, neutron radiation and other forms of wave-like radiant energy, and either non-coherent forms or coherent forms, as produced by lasers. Exposures are monochromatic, orthochromatic or panchromatic, depending upon the sepctral sensitization of the photographic silver halide. Imagewise exposure is generally for a sufficient time and intensity to produce a developable latent image in the photographic element.

A latent image in the photographic material according to the invention is developed by means known in the photographic art. Stabilization of the developed image is carried out by merely heating the developed image in association with a stabilizer precursor according to the invention. An example of a process according to the invention comprises stabilizing a developed image in a heat stabilizable photographic element according to the invention comprising heating the element to a temperature within the range of about 100° C. to about 180° C. until the developed image is stabilized. Processing is preferably carried out at ambient conditions of pressure and humidity.

Many heating means are useful for producing the necessary heating of the exposed photographic material to provide stabilization. The photographic material is heated by means of a simple hot plate, heated iron, heated rollers, dielectric heating means, air heating means or the like.

The following examples are included for a further understanding of the invention.

EXAMPLE 1

This example illustrates the invention.

A. A dispersion of triphenylphosphine was prepared by mixing the following components:

250 ml of triphenylphosphine (2 to 20 micron particle size) was added to a solution of:

0.2 ml of Triton TM X-200 (surfactant which is sodium octyl phenol poly(etheneoxy)sulfonate and is a trademark of Rohm & Haas Co., U.S.A.) in 2.3 ml of distilled water.

The resulting triphenylphosphine composition was ultrasonically mixed to produce a uniform dispersion. The triphenylphosphine dispersion was then added to the following mixture:

4.1 ml of silver chloride gelatino emulsion (50 mg of silver chloride and 210 mg of gelatin);

2.2 ml of para-toluamide dispersion: 300 mg of paratoluamide with 0.2 ml of Triton X-200 (surfactant) and 2 ml of distilled water; and 0.2 ml of glycerol.

The resulting composition was coated at about 0.102 mm (0.004 inch) wet thickness on a poly(ethylene terephthalate) film support. The coating was permitted to dry and then exposed imagewise to room light to produce a visual printout image.

When the coating, prior to roomlight exposure, was uniformly heated for five seconds at a temperature of at least 130° C., the coating showed no visual printout density when exposed to room lights for more than one hour.

B. A coating was prepared as above, with the exception that silver bromide was substituted for silver chloride, and glycerol was increased to 0.3 ml. Similar results to Part A were observed.

C. An oil-water dispersion of triphenylphosphine was prepared by adding 0.6 ml of a solution containing 3 grams of triphenylphosphine and 9 ml (toluene and dichloromethane, 1:1 parts by volume) to a solution containing 300 mg of dimethylurea. 0.1 ml of Surfactant 10G (surfactant which is a nonylphenoxypolyglycidol and is a trademark of the Olin Corporation, U.S.A.), 0.2 ml of glycerol, 210 mg of photographic gelatin and 5.4 ml of distilled water were ultrasonically mixed to produce a milky white dispersion. To the dispersion was added 4 ml of silver chloride gelatino emulsion (50 mg). The resulting composition was then coated on a poly(ethylene terephthalate) film support at about 0.102 mm (0.004 inch) wet coating thickness. Similar results to Part A were observed for this coating.

D. A coating was prepared in as Part A, with the exception that silver bromide was substituted for silver chloride. Similar results to Part A were observed.

E. An oil-water dispersion of triphenylphosphine was prepared by ultrasonically mixing a mixture of 0.6 ml of triphenylphosphine solution, as described in Part C, 0.1 ml of Surfactant 10G and 2.5 ml of distilled water. This dispersion was then added to the following formulation:

0.1 ml of 4-hydroxy-6-methyl-1,3,3a,7-tetraazaindene-sodium salt (6.8 mg) (antifoggant);

5.7 ml of photographic gelatin (10 percent by weight in water);

0.35 ml of silver bromoiodide gelatino emulsion (50 mg); and 0.47 ml of dimethylurea (300 mg).

The composition was then coated at about 0.102 mm (0.004 inch) wet coating thickness onto a poly(ethylene terephthalate) film support. Similar results to Part A were observed.

F. A coating was prepared as in Part A, with the exception that succinimide replaced dimethylurea. Similar results to Part A were observed.

EXAMPLE 2

This example illustrates the invention.

A. A dispersion containing the following was prepared:

6.5 ml of silver chloride gelatino emulsion (50 mg);

2.0 ml of dimethylurea (200 mg);

0.5 ml of glycerol; and 1.0 ml of distilled water.

The resulting composition was coated at 0.102 mm (0.004 inch) wet coating thickness on a poly(ethylene terephthalate) film support and permitted to dry. The resulting coating was overcoated with a solution containing the following:

6.0 ml of poly(vinyl butyral) (BUTVAR B-76, which is a trademark of the Monsanto Company, U.S.A.) (300 mg), acetone solution;

1.0 ml of dimethylurea (100 mg), acetone solution; and 3.0 ml of triphenylphosphine (300 mg), acetone solution. Stabilization was achieved in 10 seconds upon heating the element at 130° C.

B. An element was prepared as in Part A, with the exception that the triphenylphosphine was coated on a separate support of poly(ethylene terephthalate) film. The resulting coatings were held together in face-to-face relationship during heating at 130° C. Complete stabilization was achieved in 30 seconds.

EXAMPLE 3

A. Use of Tri-para-tolylphosphine as stabilizer precursor:

An oil-water dispersion was prepared by mixing 1.0 ml of tri-para-tolylphosphine solution (281 mg in toluene-dichloroethane, 1:1 parts by volume), 0.1 ml of Surfactant 10G and 1.6 ml of distilled water. The mixture was ultrasonically mixed to produce a milky dispersion. The dispersion was then added to a mixture of 4.0 ml of photographic silver chloride gelatino emulsion (50 mg), 0.2 ml of glycerol and 0.47 ml of dimethylurea. The resulting dispersion was coated at 0.102 mm (0.004 inch) on a poly(ethylene terephthalate) film support. Stabilization was achieved in five seconds upon heating the element at 130° C.

B. Tris-4-methoxyphenylphosphine as stabilizer precursor:

2.0 ml of photographic silver chloride gelatino emulsion (50 mg), 0.3 ml of glycerol, 3.6 ml of photographic gelatin (10 percent by weight in water), 3 ml of methylurea (300 mg), 1.24 ml of distilled water and 4 ml of tris-4-methoxyphenylphosphine (352.4 mg ball-milled to form aqueous dispersion). The resulting formulation was coated at 0.152 mm (0.006 inch) wet coating thickness on a poly(ethylene terephthalate) film support. Stabilization was achieved in ten seconds by heating the resulting element at 120° C.

C. Tri-4-chlorophenylphosphine as stabilizer precursor:

4.0 ml of tris(4-chlorophenyl)phosphine (364 mg), 2.0 ml of photographic silver chloride gelatino emulsion (50 mg), 3.6 ml of photographic gelatin (10 percent by weight in water), 0.3 of ml glycerol, 1.2 ml of paratoluamide (364 mg, milled to form aqueous dispersion), 1.0 ml of benzoic acid (100 mg, ball milled to form aqueous dispersion), and 2 ml of distilled water were coated at 0.152 mm (0.006 inch) wet coating thickness on a poly(ethylene terephthalate) film support. Stabilization of this element was achieved in ten seconds at 140° C.

EXAMPLE 4

A. Sodium(diphenyl-3-sulfonatophenylphosphine):

450 mg of sodium(diphenyl-3-sulfonatophenylphosphine) was added to 2.1 ml of photographic gelatin (10 percent by weight in water), 2.0 ml of photographic silver chloride gelatino emulsion (50 mg), 0.3 ml of glycerol, 0.3 ml of surfactant (Triton X-200), and 5.3 ml of distilled water. The resulting composition was mixed and coated at 0.102 mm (0.004 inch) wet coating thickness on a poly(ethylene terephthalate) film support. Stabilization and clearing were observed during drying of the element at 140° C.

B. The procedure described in A. above was repeated, with the exception that a photographic silver bromide gelatino emulsion (50 mg) replaced the photographic silver chloride gelatino emulsion. Similar results to Part A were observed regarding stabilization and clearing.

C. 310 mg of tris-4-hydroxyphenylphosphine (3.1 ml in aqueous dispersion), 300 mg of paratoluamide (3.0 ml aqueous dispersion), 2.1 ml of photographic gelatin (10 percent by weight in water), 2 ml of silver chloride gelatino emulsion (50 mg), and 0.3 ml of glycerol were mixed and coated at 0.102 mm (0.004 inch) wet coating thickness on a poly(ethylene terephthalate film support. Stabilization was achieved in 20 seconds upon heating the resulting element at 140° C. Clearing was observed within five seconds upon heating the element at 130° C.

This example illustrates that the described phosphine compounds are useful for stabilization and clearing processed silver chloride and silver bromide photographic materials.

EXAMPLE 5

A. 400 mg of ethyl-3-triphenyl phosphonium chloride-butyrate (stabilizer precursor) represented by the structure:

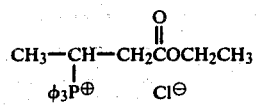

were dissolved in 4 ml of distilled water and mixed with 300 mg of para-toluamide (ball milled aqueous dispersion), 2.1 ml of photographic gelatin (10 percent by weight in water), 2.0 ml of photographic silver chloride gelatino emulsion (50 mg), and 0.3 ml of glycerol. The pH of the resulting mixture was adjusted to 6.0 with sodium hydroxide. The resulting composition was coated at 0.102 mm (0.004 inch) wet coating thickness on a poly(ethylene terephthalate) film support and dried. The material was then thermally processed. Stabilization to printout was observed to be nearly complete upon heating the element at 160° C. for 30 seconds. No stabilization was observed when the pH was not adjusted to 6.0 or higher. When the chloride ion of the stabilizer precursor was replaced with nitrate ion, similar stabilization was obtained.

B. The procedure described in Part A above was repeated, with the exception that 400 mg of ethyl-3-sulfonate phenyl diphenyl phosphonium-butyrate (stabilizer precursor) (Zwitterion) represented by the structure:

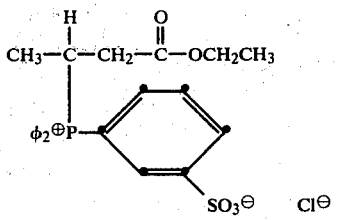

was dissolved in 4 ml of distilled water and used in place of the stabilizer precursor in Part A. Also, no paratoluamide was used. 1.6 ml of distilled water was used to make up the total volume of the composition. No stabilization was observed when the pH was allowed to remain at 3.5, and not adjusted to at least 6.0. Stabilization was observed upon heating the resulting element at 180° C. for 30 seconds when the pH of the stabilizer precursor composition was adjusted to 6.5 with sodium hydroxide. Stabilization was also observed when the element was heated at 160° C. for 30 seconds when the pH was adjusted to 8.0 with sodium hydroxide. The element also was clear upon thermal processing.

C. 406 mg of dimethyl-2-triphenylphosphoranylidene-succinate (stabilizer precursor) represented by the structure:

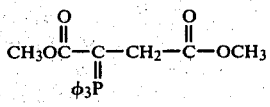

were mixed with 4 ml of distilled water, and 300 mg of para-toluamide (ball milled) in 3 ml of distilled water, 2.1 ml of photographic gelatin (10 percent by weight in water), 2.0 ml of silver bromide gelatino emulsion (60 mg), and 0.3 ml of glycerol. The resulting composition was coated on a poly(ethylene terephthalate) film support at 0.102 mm (0.004 inch) wet coating thickness. Stabilization was observed upon thermal processing of the element for 30 seconds at 170° C.

D. The procedure described in Part C was repeated, with the exception that 2.0 ml of silver chloride photographic gelatino emulsion (50 mg) was used in place of silver bromide gelatino emulsion and 100 mg of benzoic acid (in 2:1 parts by volume methanol:water). Stabilization of the resulting element was observed upon thermal processing at 160° C. for five seconds, or 140° C. for ten to fifteeen seconds.

E. 434.5 mg of diethyl-2-triphenyl-phosphoranylidene-succinate (stabilizer precursor) represented by the structure:

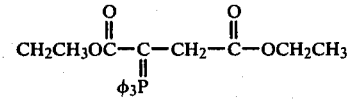

were mixed in 3 ml of distilled water with 300 mg of para-toluamide (ball milled) in 3 ml of distilled water, with 3.6 ml of photographic gelatin (10 percent by weight in water), 2.0 ml of photographic silver chloride gelatino emulsion (50 mg), 0.3 ml of glycerol, 100 mg of benzoic acid (ball milled), 0.5 ml of distilled water, and 2.6 ml of distilled water. The resulting formulation was coated at 0.152 mm (0.006 inch) wet coating thickness on a poly(ethylene terephthalate) film support. Stabilization was observed to occur upon thermally processing the resulting element at 160° C. for 10 seconds.

F. The procedure described in Part E was repeated, with the exception that 420.5 mg of methyl-2-triphenyl phosphoranylidene-3-ethoxycarbonyl-propionate (stabilizer precursor) represented by the structure:

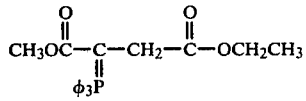

replaced the stabilizer precursor in E. Similar results were observed. The stabilizer precursor caused stabilization at 140° C. within 10 seconds.

G. The procedure described in E. was repeated, with the exception that 613.5 mg of dibutyl-2-tris(4-hydroxyphenyl)phosphoranylidene-succinate (stabilizer precursor) represented by the structure:

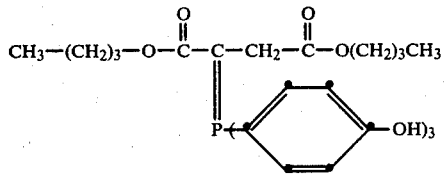

was used. 300 mg of methylurea (in 3 ml of water) was used in place of para-toluamide. Stabilization and clearing were observed to occur in the element upon thermal processing at 180° C. within ten seconds. Nearly complete stabilization and clearing were observed when the element was heated at 160° C. for ten seconds, or 140° C. for sixty seconds.

H. The procedure described in Part E was repeated, with the exception that 457 mg of dimethyl-2-tris(3-hydroxyphenyl)phosphoranylidene-succinate (stabilizer precursor) represented by the structure:

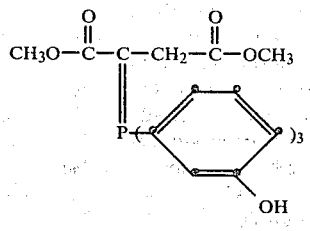

in 4 ml of water was used. 100 mg of benzoic acid was omitted. Stabilization of the resulting element and clearing were observed upon processing the element at 140° C. for ten seconds.

I. The procedure described in Part E was repeated, with the exception that 407 mg of the N-ethyl-3-triphenyl phosphoranylidene-succinate (stabilizer precursor) represented by the structure:

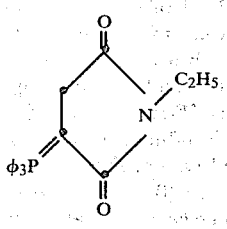

in 5.5 ml of water was used. Also, 0.24 ml of distilled water was used to make up the total volume to 14.16 ml. The resulting composition was coated at 0.152 mm (0.006 inch) wet coating thickness on a poly(ethylene terephthalate) film support. Stabilization was observed upon thermal processing of the resulting element at 140° C. within ten seconds.

EXAMPLE 6

2.5 ml of photographic silver chloride gelatino emulsion (50 mg) were mixed with 0.4 ml of 4-hydroxy-6-methyl-1,3,3a,7-tetraazaindene (antifoggant) (27 mg), 3.62 ml of photographic gelatin (10 percent by weight in water), 0.2 ml of glycerol, 406.5 mg of the stabilizer precursor from Example 5C, 300 mg of para-toluamide, 100 mg of benzoic acid, and 50 mg of ascorbic acid. The resulting composition was adjusted to a pH of 5.0 with potassium hydroxide. The resulting formulation was then coated on a poly(ethylene terephthalate) film support at a 0.152 mm thickness (0.006 inch) wet coating thickness. The resulting element was imagewise exposed for $10^{-3}$ seconds by means of a light source and a commercial sensitometer, and then processed for ten seconds at 140° C. The resulting developed image had a maximum density of 0.75 and a minimum density of 0.14. The processed element was stabilized to printout.

EXAMPLE 7

The following composition was mixed and coated on a poly(ethylene terephthalate) film support at a 0.102 mm (0.004 inch) wet coating thickness:

| | per dm$^2$ |
|---|---|
| Surfactant (Surfactant 10G which is para-isononylphenoxy-polyglycidol, a trademark of and available from the Olin Corp., U.S.A.) | 0.0022 ml |
| Photographic gelatin | 21.6 mg |

-continued

| | per dm$^2$ |
|---|---|
| Methylsuccinic acid | 10.8 mg |
| Potassium hydroxide (pH 6.0) | 8.7 mg |
| Silver chloride | 16.2 mg |

The resulting photographic element was imagewise exposed to light for $10^{-3}$ in a commercial sensitometer to provide a developable latent image in the element. The image was developed by processing for three minutes at room temperature (about 19° C.) in the following developer:

| | grams |
|---|---|
| monomethyl-para-aminophenol sulfonate (developing agent) | 5.0 |
| hydroquinone | 10.0 |
| $Na_2SO_3$ | 75.0 |
| $NaCO_3$ | 50.0 |
| KBr | 2.0 |
| (pH 10.3) (water to 1 liter) | |

Upon processing, the speed loss at 0.3 density above fog was determined. The following results were obtained:

| Stabilizer | Amount Necessary In Coating to Produce a 0.3 Log E Speed Loss |
|---|---|
| (a) Tris-4-hydroxyphenyl phosphine | 10.0 percent |
| (b) $(NH_2)_2C{=}\overset{\oplus}{N}H_2\ HS(CH_2)_2SO_3^{\ominus}$ | 0.03 percent |
| (c) $HS{-}(CH_2)_2{-}NH{-}\overset{O}{\overset{\|}{C}}{-}NHCH_3$ | 0.03 percent |

This illustrates that phosphine stabilizer precursors provide improved stability of silver halide sensitization at low levels of pre-released stabilizer compared to sulfur stabilizers.

EXAMPLE 8

A photothermographic coating was prepared containing, per square meter, 0.68 grams of photographic silver bromoiodide gelatino emulsion, 0.93 grams of silver behenate (organic silver salt oxidizing agent), 1.23 grams of 2,6-dichlorobenzenesulfonamidophenol (organic reducing agent for the oxidizing agent), $3.75\times10^{-4}$ grams of sensitizing dye, and $3.75\times10^{-4}$ grams of 3-ethyl-2-thio-2,4-oxazolidenedione. The resulting photographic layer was overcoated by a solution containing the following: triphenylphosphine (0.58 grams), poly(vinyl butyral) (BUTVAR B-76, which is a trademark of and available from the Monsanto Company, U.S.A.) (0.53 grams), and 0.008 grams of a siloxane spreading agent (AF-70, which is a trademark of and available from the General Electric Company, U.S.A.) in 14 ml of acetone-toluene (20 percent acetone and 80 percent toluene). The overcoat (B) was applied at 0.152 mm (0.006 inch) wet coating thickness and air dried after each coating. The resulting element was heated at 120° C., 140° C. and 150° C. for ten seconds. The coating also was observed when unprocessed. The photographic element containing the triphenylphosphine demonstrated total stabilization upon processing.

No attempt was made at producing an image in the photothermographic material of this Example. However, images were produced in a photothermographic element of this Example containing no overcoat. The resulting images were stabilized by sandwiching the photothermographic element, after imagewise exposure and thermal processing, with a separate element comprising a layer of the phosphine stabilizer precursor in a binder on a support and then heating the resulting sandwich for several seconds at 150° C.

The photographic element which contained no overcoat and the photographic element that was overcoated, except that triphenylphosphine was omitted, showed high visual printout when exposed to room light (blue fluorescent light at 120 footcandles) for more than one day.

EXAMPLE 9

The procedure described in Example 8, was repeated, with the exception that 0.8 grams of tris(4-chlorophenyl)phosphine was used in place of triphenylphosphine. Stabilization and clearing of the resulting elements were obtained when the elements were processed for ten seconds at 120° C. or 140° C. The processed elements were exposed to room light (blue fluorescent light at 120 footcandles) for four days. The element that contained no overcoating showed a specular density of 0.46 when processed for ten seconds at 120° C. prior to light exposure, compared to a specular density of 0.14 for the element containing the phosphine stabilizer precursor. The photographic element (A), when processed for ten seconds at 140° C. prior to light exposure, showed a specular density of 1.43, compared to a specular density of 0.08 for the phosphine overcoated coating. This illustrates that the tris(4-chlorophenyl)phosphine stabilizer precursor is effective in a photothermographic element designed for dry physical development.

EXAMPLE 10

A composition was prepared containing 51 mg of photographic silver bromoiodide, 50 mg of silver behenate, 813 mg of dimethyl-2-triphenyl phosphoranylidene-succinate (stabilizer precursor), 244 mg of benzoic acid, 525 mg of poly(vinyl butyral) (binder) (BUTVAR B-76, which is a trademark of and available from the Monsanto Company, U.S.A.), and 8 mg of a siloxane spreading agent (AF-70, which is a trademark of and available from the General Electric Company, U.S.A.) in 16.5 ml of acetone-toluene (20 percent acetone and 80 percent toluene). The resulting composition was coated on a poly(ethylene terephthalate) film support at a thickness of about 0.18 mm (0.007 inch) wet coating thickness and dried in air. Complete stabilization to printout was obtained when the element was processed for ten seconds at 140° C. The unprocessed element, upon exposure to light, produced a specular density of 1.26. The processed element, upon exposure to light, produced a specular density of 0.27. X-ray diffraction analysis showed that 0.48 grams per square meter of silver as silver bromoiodide was present in the unprocessed photographic element, and that no silver bromoiodide was present in the coating that was thermally processed at 140° C. for ten seconds. This demonstrated that the dimethyl-2-triphenyl phosphoranylidene-succinate was an effective stabilizer precursor in a photographic element designed for dry physical development.

EXAMPLE 11

This is a comparative example.

A composition was prepared by mixing 300 mg of para-toluamide (ball-milled dispersion), 250 mg of triphenylphosphineoxide (ball milled), 0.2 ml of surfactant (Triton X-200), and 210 mg of photographic gelatin in 4.7 ml of distilled water with photographic silver chloride gelatino emulsion (50 mg of silver) and 0.3 ml of glycerol and 2.3 ml of distilled water. The resulting composition was coated on a poly(ethylene terephthalate) film support at 0.102 mm (0.004 inch) wet coating thickness, chill set and then air dried. The resulting photographic element was processed for thirty seconds at 160° C. No stabilization was observed.

The phosphorous compound of this Example does not contain a lone electron pair on the phosphorous atom.

The invention has been described in detail with particular reference to preferred embodiments thereof, but it will be understood that variations and modifications can be effected within the spirit and scope of the invention.

What is claimed is:

1. In a heat stabilizable photographic silver halide element comprising a support having thereon, in binder, in reactive association, (a) photographic silver halide, and (b) a silver halide stabilizer precursor, the improvement comprising:

as said stabilizer precursor, a silver halide stabilizing concentration of a phosphorane represented by the formula:

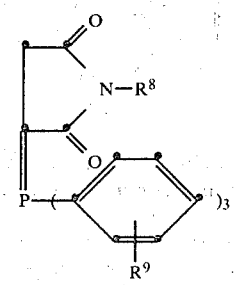

wherein:

$R^8$ is hydrogen, alkyl containing 1 to 20 carbon atoms or aryl containing 6 to 12 carbon atoms; and $R^9$ is hydrogen or alkyl containing 1 to 3 carbon atoms.

2. In a heat developable and heat stabilizable photographic element comprising a support having thereon, in a gelatino binder, in reactive association: (a) photographic silver halide, (b) a silver halide developing agent, and (c) a buffering concentration of an organic acid buffering agent, the improvement comprising:

(d) a stabilizing concentration of a phosphorane represented by the formula:

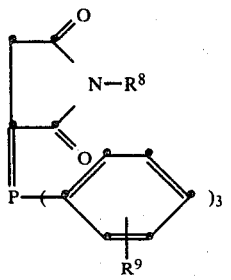

wherein:

$R^8$ is hydrogen, alkyl containing 1 to 20 carbon atoms or aryl containing 6 to 12 carbon atoms; and $R^9$ is hydrogen or alkyl containing 1 to 3 carbon atoms.

3. In a heat developable and heat stabilizable photographic element comprising a support having thereon, in a polymeric binder, in reactive association:

(a) photographic silver halide, (b) an oxidation-reduction image-forming combination comprising:

(i) an organic silver salt oxidizing agent, with (ii) a reducing agent for the organic silver salt oxidizing agent, and (c) a stabilizing concentration of a stabilizer precursor, the improvement comprising:

as said stabilizer precursor, a silver halide stabilizing concentration of a phosphorane represented by the formula:

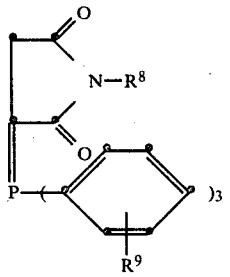

wherein: $R^8$ is hydrogen or alkyl containing 1 to 20 carbon atoms or aryl containing 6 to 12 carbon atoms.

4. In a heat stabilizable photographic silver halide composition comprising, (a) photographic silver halide, and (b) a silver halide stabilizing concentration of a silver halide stabilizer precursor, the improvement comprising:

as said stabilizer precursor, a phosphorane represented by the formula:

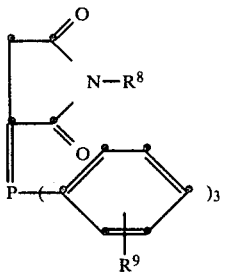

wherein:

$R^8$ is hydrogen, alkyl containing 1 to 20 carbon atoms or aryl containing 6 to 12 carbon atoms; and $R^9$ is hydrogen or alkyl containing 1 to 3 carbon atoms.

5. A heat developable and heat stabilizable photographic composition comprising, in a gelatino binder, (a) photographic silver halide, (b) a silver halide developing agent, and (c) a buffering concentration of an organic acid buffering agent, the improvement comprising:

(d) a silver halide stabilizing concentration of a phosphorane represented by the formula:

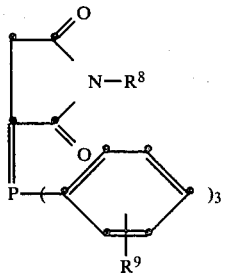

wherein:

$R^8$ is hydrogen, alkyl containing 1 to 20 carbon atoms or aryl containing 6 to 12 carbon atoms; and $R^9$ is hydrogen or alkyl containing 1 to 3 carbon atoms.

6. A heat developable and heat stabilizable photographic composition comprising, in a polymeric binder, (a) photographic silver halide, (b) an oxidation-reduction image-forming combination comprising: (i) an organic silver salt oxidizing agent, with (ii) a reducing agent for the organic silver salt oxidizing agent, and (c) a stabilizing concentration of a stabilizer precursor, the improvement comprising:

as said stabilizer precursor, a phosphorane represented by the formula:

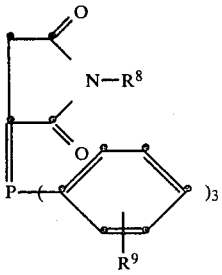

wherein: $R^8$ is hydrogen or alkyl containing 1 to 20 carbon atoms or aryl containing 6 to 12 carbon atoms.

7. In a heat stabilizable photographic silver halide element comprising a support having thereon, in binder, in reactive association, (a) photographic silver halide, and (b) a silver halide stabilizer precursor, the improvement comprising:

as said stabilizer precursor, a silver halide stabilizing concentration of a triarylphosphorane compound which, upon being heated to a temperature above about 100° C., releases a phosphorous compound silver halide stabilizer that contains a lone electron pair on the phosphorous atom of the stabilizer.

8. A heat stabilizable photographic silver halide element as in claim 1 wherein said silver halide stabilizing concentration is within the range of 1.5 mole to 3.0 moles of said stabilizer precursor per mole of total silver in the photographic silver halide element.

9. A heat stabilizable photographic silver halide element as in claim 1 wherein said silver halide stabilizing concentration is within the range of 1.5 mole to 3.0 moles of said stabilizer precursor per mole of total silver in the photograpic silver halide element.

10. A heat stabilizable photographic silver halide element as in claim 1 wherein said stabilizer precursor consists essentially of N-ethyl-3-triphenylphosphoranylidene-succinimide represented by the formula:

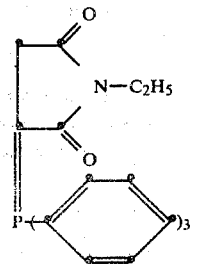

11. A heat stabilizable photographic silver halide element as in claim 7 wherein said stabilizer precursor consists essentially of a triphenylphosphorane represented by the formula:

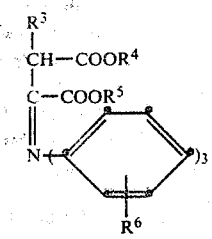

wherein:

$R^3$ is hydrogen or alkyl containing 1 to 3 carbon atoms;

$R^4$ is hydrogen or alkyl containing 1 to 20 carbon atoms;

$R^5$ is hydrogen or alkyl containing 1 to 20 carbon atoms; and $R^6$ is hydrogen, alkyl containing 1 to 3 carbon atoms, hydroxyl, alkoxy containing 1 to 3 carbon atoms, chlorine, bromine, fluorine or iodine, or $$-O-\overset{O}{\overset{\|}{C}}-R^7$$

wherein $R^7$ is alkyl containing 1 to 3 carbon atoms.

12. A heat stabilizable photographic silver halide element as in claim 7 wherein said stabilizer precursor consists essentially of dimethyl-2-tris(3-hydroxyphenyl)phosphoranylidene-succinate represented by the formula:

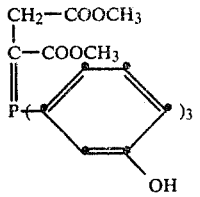

13. A heat stabilizable photographic silver halide element as in claim 7 also comprising a concentration of organic acid which aids release of a silver halide stabilizer from the stabilizer precursor.

14. A heat stabilizable photographic silver halide element as in claim 7 also comprising a concentration of benzoic acid which aids release of a silver halide stabilizer from the stabilizer precursor.

15. In a heat developable and heat stabilizable photographic element comprising a support having thereon, in a gelatino binder, in reactive association: (a) photographic silver halide, (b) a silver halide developing agent, and (c) a buffering concentration of an organic acid buffering agent, the improvement comprising:

(d) a stabilizing concentration of a triarylphosphine or triarylphosphorane silver halide stabilizer precursor which, upon being heated to a temperature above about 100° C., releases a phosphorous compound silver halide stabilizer that contains a lone electron pair on the phosphorous atom of the stabilizer.

16. A heat developable and heat stabilizable photographic element as in claim 15 wherein said stabilizer precursor consists essentially of a triphenylphosphine silver halide stabilizer precursor.

17. A heat developable and heat stabilizable photographic element as in claim 15 wherein said stabilizer precursor consists essentially of a triphenylphosphine represented by the formula:

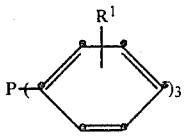

wherein:

$R^1$ is hydrogen, alkyl containing 1 to 3 carbon atoms, hydroxyl, alkoxy containing 1 to 3 carbon atoms, chlorine, bromine, fluorine or iodine, or $$-O-\overset{O}{\overset{\|}{C}}-R^2$$

wherein $R^2$ is alkyl containing 1 to 3 carbon atoms.

18. A heat developable and heat stabilizable photographic element as in claim 15 wherein said stabilizer precursor consists essentially of a triphenylphosphorane silver halide stabilizer precursor.

19. A heat developable and heat stabilizable photographic element as in claim 2 wherein said stabilizer precursor consists essentially of N-ethyl-3-triphenylphosphoranylidene-succinimide represented by the formula:

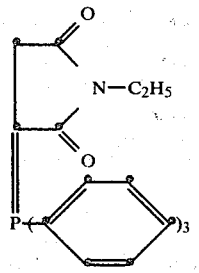

20. A heat developable and heat stabilizable photographic element as in claim 15 wherein said stabilizer precursor consists essentially of a phosphorane represented by the formula:

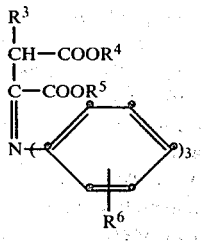

wherein:

$R^3$ is hydrogen or alkyl containing 1 to 3 carbon atoms;

$R^4$ and $R^5$ are individually hydrogen or alkyl containing 1 to 20 carbon atoms $R^6$ is hydrogen, alkyl containing 1 to 3 carbon atoms, hydroxyl, alkoxy containing 1 to 3 carbon atoms, chlorine, bromine, fluorine or iodine, or

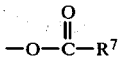

wherein $R^7$ is alkyl containing 1 to 3 carbon atoms.

21. A heat developable and heat stabilizable photographic element as in claim 15 wherein said stabilizer precursor consists essentially of dimethyl-2-tris(3-hydroxyphenyl)phosphoranylidene-succinate represented by the formula:

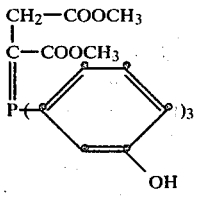

22. A heat developable and heat stabilizable photographic element as in claim 7 also comprising a concentration of organic acid which aids release of a silver halide stabilizer from the stabilizer precursor.

23. A heat developable and heat stabilizable photographic element as in claim 7 also comprising a concentration of benzoic acid which aids release of the phosphorous compound silver halide stabilizer.

24. A heat developable and heat stabilizable photographic element comprising a support having thereon, in a gelatino binder, in reactive association:

(a) photographic silver halide, (b) an ascorbic acid silver halide developing agent, (c) an organic acid buffering agent consisting essentially of methylsuccinic acid, (d) an antifoggant concentration of a tetraazaindene antifoggant, and (e) a stabilizing concentration of a silver halide stabilizer precursor consisting essentially of dimethyl-2-tris(3-hydroxyphenyl)phosphoranylidene-succinate represented by the formula:

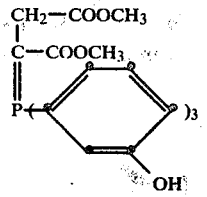

25. In a heat developable and heat stabilizable photographic element comprising a support having thereon, in a polymeric binder, in reactive association:

(a) photographic silver halide, (b) an oxidation-reduction image-forming combination comprising:

(i) an organic silver salt oxidizing agent, with (ii) a reducing agent for the organic silver salt oxidizing agent, and (c) a stabilizing concentration of a stabilizer precursor, the improvement comprising:

as said stabilizer precursor, a triarylphosphine or triarylphosphorane compound which, upon being heated to a temperature above about 100° C., releases a phosphorous compound silver halide stabilizer that contains a lone electron pair on the phosphorous atom of the stabilizer.

26. A heat developable and heat stabilizable photographic element as in claim 25 wherein said stabilizer precursor is a triphenylphosphine silver halide stabilizer precursor.

27. A heat developable and heat stabilizable photographic element as in claim 25 wherein said stabilizer precursor consists essentially of a triphenylphosphine represented by the formula:

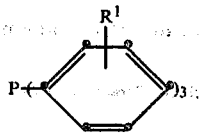

wherein:

$R^1$ is hydrogen, alkyl containing 1 to 3 carbon atoms, hydroxyl, alkoxy containing 1 to 3 carbon atoms, chlorine, bromine, fluorine or iodine, or

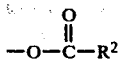

wherein $R^2$ is alkyl containing 1 to 3 carbon atoms.

28. A heat developable and heat stabilizable photographic element as in claim 25 wherein said stabilizer precursor consists essentially of a triphenylphosphorane silver halide stabilizer precursor.

29. A heat developable and heat stabilizable photographic element as in claim 3 wherein said stabilizer precursor consists essentially of N-ethyl-3-triphenylphosphoranylidene-succinimide represented by the formula:

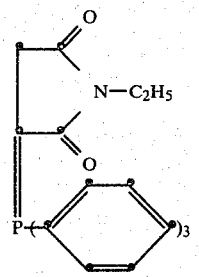

30. A heat developable and heat stabilizable photographic element as in claim 25 wherein said stabilizer precursor consists essentially of a triphenylphosphorane represented by the formula:

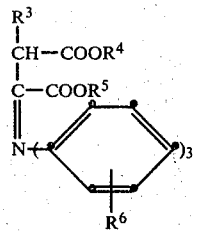

wherein:

$R^3$ is hydrogen or alkyl containing 1 to 3 carbon atoms;

$R^4$ and $R^5$ are individually hydrogen or alkyl containing 1 to 20 carbon atoms;

$R^6$ is hydrogen, alkyl containing 1 to 3 carbon atoms, hydroxyl, alkoxy containing 1 to 3 carbon atoms, chlorine, bromine, fluorine or iodine, or

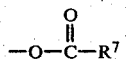

wherein $R^7$ is alkyl containing 1 to 3 carbon atoms.

31. A heat developable and heat stabilizable photographic element as in claim 25 wherein said stabilizer precursor consists essentially of dimethyl-2-tris(3-hydroxyphenyl)phosphoranylidene-succinate represented by the formula:

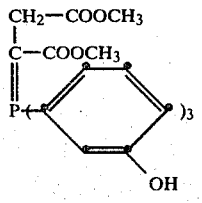

32. A heat developable and heat stabilizable photographic element as in claim 25 also comprising a concentration of organic acid which aids the release of the phosphorous compound silver halide stabilizer.

33. A heat developable and heat stabilizable photographic element as in claim 25 also comprising a concentration of benzoic acid which aids release of the phosphorous compound silver halide stabilizer.

34. In a heat developable and heat stabilizable photographic element comprising a support having thereon, in a polymeric binder, in reactive association, (a) photographic silver halide, (b) an oxidation-reduction image-forming combination comprising:

(i) an organic silver salt oxidizing agent consisting essentially of silver behenate, with (ii) a sulfonamidophenol reducing agent for the organic silver salt oxidizing agent, (c) a 3-ethyl-2-thio-2,4-oxazolidinedione speed increasing addendum, the improvement comprising:

(d) a phosphorous compound silver halide stabilizer precursor consisting essentially of triphenylphosphine.

35. In a heat stabilizable photographic silver halide composition comprising, (a) photographic silver halide, and (b) a silver halide stabilizing concentration of a silver halide stabilizer precursor, the improvement comprising:

as said stabilizer precursor, a triarylphosphorane compound which, upon being heated to a temperature above about 100° C., releases a phosphorous compound silver halide stabilizer that contains a lone electron pair on the phosphorous atom of the stabilizer.

36. A heat stabilizable photographic silver halide composition as in claim 4 wherein said stabilizer precursor consists essentially of N-ethyl-3-triphenylphosphoranylidene-succinimide represented by the formula:

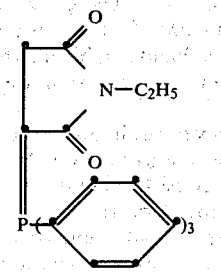

37. A heat stabilizable photographic silver halide composition as in claim 35 wherein said stabilizer precursor consists essentially of a triphenylphosphorane represented by the formula:

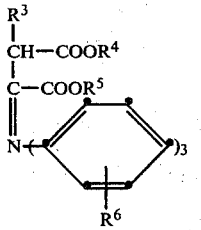

wherein:

$R^3$ is hydrogen or alkyl containing 1 to 3 carbon atoms;

$R^4$ and $R^5$ are individually hydrogen or alkyl containing 1 to 20 carbon atoms;

$R^6$ is hydrogen, alkyl containing 1 to 3 carbon atoms, hydroxyl, alkoxy containing 1 to 3 carbon atoms, chlorine, bromine, fluorine or iodine, or

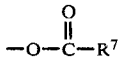

wherein $R^7$ is alkyl containing 1 to 3 carbon atoms.

38. A heat stabilizable photographic silver halide composition as in claim 35 wherein said stabilizer precursor consists essentially of dimethyl-2-tris(3-hydroxyphenyl)phosphoranylidene-succinate represented by the formula:

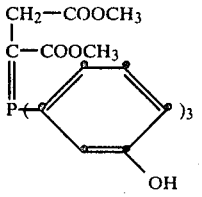

39. A heat stabilizable photographic silver halide composition as in claim 35 also comprising a concentration of benzoic acid which aids release of a silver halide stabilizer from the stabilizer precursor.

40. In a heat developable and heat stabilizable photographic composition comprising, in a gelatino binder, (a) photographic silver halide, (b) a silver halide developing agent, and (c) a buffering concentration of an organic acid buffering agent, the improvement comprising:

(d) a stabilizing concentration of a triarylphosphine or triarylphosphorane silver halide stabilizer precursor which, upon being heated to a temperature above about 100° C., releases a phosphorous compound silver halide stabilizer that contains a lone electron pair on the phosphorus atom of the stabilizer.

41. A heat developable and heat stabilizable photographic composition as in claim 40 wherein said stabilizer precursor consists essentially of a triphenylphosphine silver halide stabilizer precursor.

42. A heat developable and heat stabilizable photographic composition as in claim 40 wherein said stabilizer precursor consists essentially of a triphenylphosphine represented by the formula:

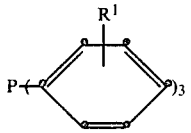

wherein:

$R^1$ is hydrogen, alkyl containing 1 to 3 carbon atoms, hydroxyl, alkoxy containing 1 to 3 carbon atoms, chlorine, bromine, fluorine or iodine, or

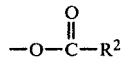

wherein $R^2$ is alkyl containing 1 to 3 carbon atoms.

43. A heat developable and heat stabilizable photographic composition as in claim 40 wherein said stabilizer precursor consists essentially of a triphenylphosphorane silver halide stabilizer precursor.

44. A heat developable and heat stabilizable photographic composition as in claim 5 wherein said stabilizer precursor consists essentially of N-ethyl-3-triphenylphosphoranylidene-succinimide represented by the formula:

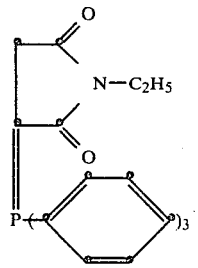

45. A heat developable and heat stabilizable photographic composition as in claim 40 wherein said stabilizer precursor consists essentially of a phosphorane represented by the formula:

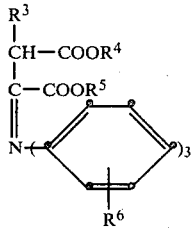

wherein:

$R^3$ is hydrogen or alkyl containing 1 to 3 carbon atoms;

$R^4$ and $R^5$ are individually or alkyl containing 1 to 20 carbon atoms;

$R^6$ is hydrogen, alkyl containing 1 to 3 carbon atoms, hydroxyl, alkoxy containing 1 to 3 carbon atoms, chlorine, bromine, fluorine or iodine, or

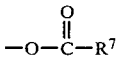

wherein $R^7$ is alkyl containing 1 to 3 carbon atoms.

46. A heat developable and heat stabilizable photographic composition as in claim 40 wherein said stabilizer precursor consists essentially of dimethyl-2-tris(3-hydroxyphenyl)phosphoranylidene-succinate represented by the formula:

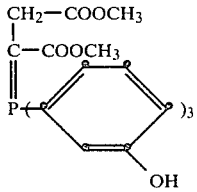

47. A heat developable and heat stabilizable photographic composition as in claim 40 also comprising a concentration of benzoic acid which aids release of the phosphorous compound silver halide stabilizer.

48. A heat developable and heat stabilizable photographic composition comprising, in a gelatino binder,
(a) photographic silver halide,
(b) an ascorbic acid silver halide developing agent,
(c) an organic acid buffering agent consisting essentially of methylsuccinic acid,
(d) an antifoggant concentration of a tetraazaindene antifoggant,
(e) a stabilizing concentration of a silver halide stabilizer precursor consisting essentially of dimethyl-2-tris(3-hydroxyphenyl)phosphoranylidene-succinate represented by the formula:

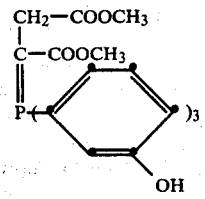

49. In a heat developable and heat stabilizable photographic composition comprising, in a polymeric binder, (a) photographic silver halide, (b) an oxidation-reduction image-forming combination comprising: (i) an organic silver salt oxidizing agent, with (ii) a reducing agent for the organic silver salt oxidizing agent, and (c) a stabilizing concentration of a stabilizer precursor, the improvement comprising:
as said stabilizer precursor, a triarylphosphine or triarylphosphorane compound which, upon being heated to a temperature above about 100° C., releases a phosphorous compound silver halide stabilizer that contains a lone electron pair on the phosphorous atom of the stabilizer.

50. A heat developable and heat stabilizable photographic composition as in claim 49 wherein said stabilizer precursor is a triphenylphosphine silver halide stabilizer precursor.

51. A heat developable and heat stabilizable photographic composition as in claim 49 wherein said stabilizer precursor consists essentially of a triphenylphosphine represented by the formula:

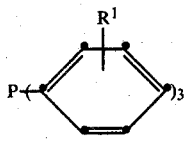

wherein:
$R^1$ is hydrogen, alkyl containing 1 to 3 carbon atoms, hydroxyl, alkoxy containing 1 to 3 carbon atoms, chlorine, bromine, fluorine or iodine, or

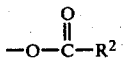

wherein $R^2$ is alkyl containing 1 to 3 carbon atoms.

52. A heat developable and heat stabilizable photographic composition as in claim 49 wherein said stabilizer precursor consists essentially of a triphenylphosphorane silver halide stabilizer precursor.

53. A heat developable and heat stabilizable photographic composition as in claim 6 wherein said stabilizer precursor consists essentially of N-ethyl-3-triphenylphosphoranylidene-succinimide represented by the formula:

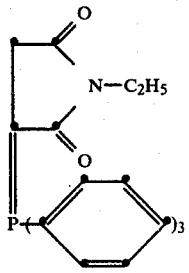

54. A heat developable and heat stabilizable photographic composition as in claim 49 wherein said stabilizer precursor consists essentially of a triphenylphosphorane represented by the formula:

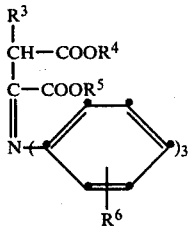

wherein:
$R^3$ is hydrogen or alkyl containing 1 to 3 carbon atoms;
$R^4$ and $R^5$ are individually hydrogen or alkyl containing 1 to 20 carbon atoms;
$R^6$ is hydrogen, alkyl containing 1 to 3 carbon atoms, hydroxyl, alkoxy containing 1 to 3 carbon atoms, chlorine, bromine, fluorine or iodine, or

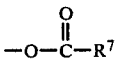

wherein $R^7$ is alkyl containing 1 to 3 carbon atoms.

55. A heat developable and heat stabilizable photographic composition as in claim 49 wherein said stabilizer precursor consists essentially of dimethyl-2-tris(3-hydroxyphenyl)phosphoranylidene-succinate represented by the formula:

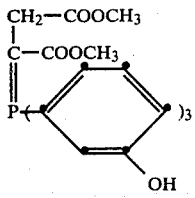

56. A heat developable and heat stabilizable photographic composition as in claim 49 also comprising a concentration of an organic acid which aids release of the phosphorous compound silver halide stabilizer.

57. A heat developable and heat stabilizable photographic composition as in claim 49 also comprising a concentration of benzoic acid which aids release of the phosphorous compound silver halide stabilizer.

58. In a heat developable and heat stabilizable photographic composition comprising, in a polymeric binder, (a) photographic silver halide, (b) an oxidation-reduction image-forming combination comprising: (i) an organic silver salt oxidizing agent consisting essentially of silver behenate, with (ii) a sulfonamidophenol reducing agent for the organic silver salt oxidizing agent, (c) a 3-ethyl-2-thio-2,4-oxazolidinedione speed increasing addendum, the improvement comprising:

(d) a stabilizing concentration of silver halide stabilizer precursor consisting essentially of triphenylphosphine.

59. A process of stabilizing a developed image in a heat stabilizable photographic element as defined in claim 7 comprising heating said element to a temperature within the range of about 100° C. to about 180° C. until the developed image is stabilized.

60. A process of developing and stabilizing an image in an exposed heat developable and heat stabilizable photographic element as defined in claim 15 comprising heating said element to a temperature within the range of about 100° C. to about 180° C. until an image is developed and stabilized.

61. A process of developing and stabilizing an image in an exposed heat developable and heat stabilizable photographic element as defined in claim 24 comprising heating said element to a temperature within the range of about 100° C. to about 180° C. until an image is developed and stabilized.

62. A process of developing and stabilizing an image in an exposed heat developable and heat stabilizable photographic element as defined in claim 25 comprising heating said element to a temperature within the range of about 100° C. to about 180° C. until an image is developed and stabilized.

63. A process of developing and stabilizing an image in an exposed heat developable and heat stabilizable photographic element as defined in claim 34 comprising heating said element to a temperature within the range of about 100° C. to about 180° C. until an image is developed and stabilized.

* * * * *

UNITED STATES PATENT AND TRADEMARK OFFICE

CERTIFICATE OF CORRECTION

PATENT NO. 4,411,985

DATED October 25, 1983

INVENTOR(S) Lawrence R. Morrow and John Thatcher

It is certified that error appears in the above-identified patent and that said Letters Patent are hereby corrected as shown below:

Col. 25, line 40, the part of the structure reading

" 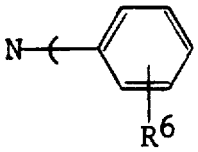 " should read -- 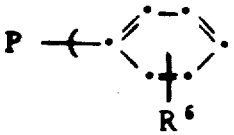 --.

Col. 27, line 24, the part of the structure reading

" 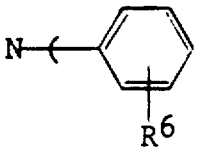 " should read -- 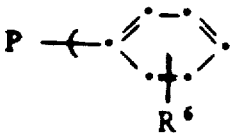 --.

UNITED STATES PATENT AND TRADEMARK OFFICE

CERTIFICATE OF CORRECTION

PATENT NO. 4,411,985

DATED October 25, 1983

INVENTOR(S) Lawrence R. Morrow and John Thatcher

It is certified that error appears in the above-identified patent and that said Letters Patent are hereby corrected as shown below Col. 29, line 30, the part of the structure reading " 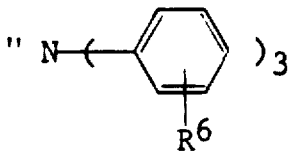 " should read — 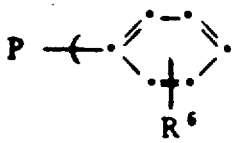 —.

Col. 30, line 59, the part of the structure reading

" 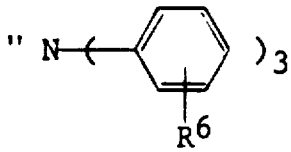 " should read — 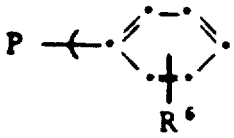 —

UNITED STATES PATENT AND TRADEMARK OFFICE

CERTIFICATE OF CORRECTION

PATENT NO. 4,411,985

DATED October 25, 1983

INVENTOR(S) Lawrence R. Morrow and John Thatcher

It is certified that error appears in the above-identified patent and that said Letters Patent are hereby corrected as shown below Col. 32, line 33, the part of the structure reading " 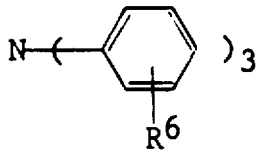 " should read — 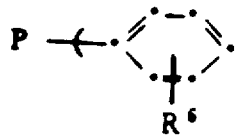 —.

Col. 32, line 39, after "individually" insert --hydrogen--.

Col. 34, line 27, the part of the structure reading

" 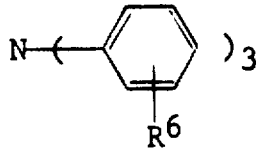 " should read — 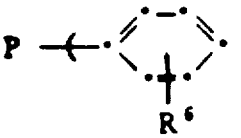 —.

Signed and Sealed this

*Twenty-ninth* Day of *January 1985*

[SEAL]

*Attest:*

DONALD J. QUIGG

*Attesting Officer* *Acting Commissioner of Patents and Trademarks*